US007730810B1

(12) United States Patent
Janson

(10) Patent No.: US 7,730,810 B1
(45) Date of Patent: Jun. 8, 2010

(54) PUSH BUTTON MULTI-POSITION LOCKING PLIERS AND METHOD OF USE

(76) Inventor: Paul M. Janson, 19151 Tulsa St., Northridge, CA (US) 91326

( * ) Notice: Subject to any disclaimer, the term of this patent is extended or adjusted under 35 U.S.C. 154(b) by 0 days.

(21) Appl. No.: 11/820,204

(22) Filed: Jun. 18, 2007

Related U.S. Application Data

(60) Provisional application No. 60/814,946, filed on Jun. 19, 2006.

(51) Int. Cl.
*B25B 7/12* (2006.01)
*B25B 7/04* (2006.01)

(52) U.S. Cl. ..... 81/367; 81/405; 81/409.5

(58) Field of Classification Search ..... 81/356, 81/363, 367, 383, 386, 391, 392, 394, 405, 81/409.5, 411, 412, 368–382, 406–409, 413, 81/416, 417, 427, DIG. 4, DIG. 9; D8/52
See application file for complete search history.

(56) References Cited

U.S. PATENT DOCUMENTS 3,672,245 A * 6/1972 Hoffman ..... 81/367
3,981,209 A * 9/1976 Caroff ..... 81/367
4,296,655 A * 10/1981 Tesoro ..... 81/405
4,773,288 A * 9/1988 Jang et al. ..... 81/409.5
5,022,290 A * 6/1991 Duffy ..... 81/355
5,813,297 A * 9/1998 Zepkowski ..... 81/426.5
6,012,361 A * 1/2000 Wooster et al. ..... 81/367
6,408,725 B1 * 6/2002 Janson ..... 81/407
6,578,452 B2 * 6/2003 Duffy ..... 81/368
7,182,004 B1 * 2/2007 Wang ..... 81/409.5
2001/0054335 A1 * 12/2001 Harman ..... 81/367
2004/0000221 A1 * 1/2004 Kesinger et al. ..... 81/367

FOREIGN PATENT DOCUMENTS

FR 2786119 A1 * 5/2000

* cited by examiner

*Primary Examiner*—David B Thomas
(74) *Attorney, Agent, or Firm*—Timothy Thut Tyson; Ted Masters; Freilich, Hornbaker & Rosen

(57) ABSTRACT

A push-button locking pliers has a plurality of macro jaw width stations for grasping a wide variety of objects. A positioning mechanism is connected to a movable jaw member and cooperates with a jaw adjustment slot in the main handle. The positioning mechanism is released by pushing on a push button allowing, it to move along the slot. The user places the positioning mechanism at the jaw positioning station that creates a macro spacing between the fixed and movable jaws that best fits the object to be grasped. An adjustment screw adjusts the micro spacing between the jaws to cause the pliers to lock on the object using an over-center mechanism when the handles are squeezed.

1 Claim, 9 Drawing Sheets

266
294
296
270
286
284
242
274
222
290
292
264

PUSH BUTTON MULTI-POSITION LOCKING PLIERS AND METHOD OF USE

CROSS REFERENCE TO RELATED APPLICATION

This application claims the filing benefit under 35 U.S.C. §119(e) of U.S. Provisional Application No. 60/814,946, filed Jun. 19, 2006, which is included herein by reference.

TECHNICAL FIELD

The present invention relates generally to the field of hand tools, and more particularly to locking pliers having jaws that are selectively spaced apart in one of a plurality of positions to accommodate objects of various sizes prior to engaging the locking mechanism.

BACKGROUND OF THE INVENTION

Locking pliers are well known in the art. These devices have two jaws that may be locked on an object. The over-center locking mechanism is achieved by two handles, a fixed jaw on one of the handles, a movable jaw, a pivoting link between the handles, and an over-center spring between the movable jaw and the fixed jaw handle that together cooperate to lock the jaws on a work piece when the handles are forced together. The over-center mechanism includes a micro adjustment screw that controls the opening of the jaws over a limited range to accommodate articles of different sizes within the range and permits the over-center mechanism to lock. An example of such locking pliers is shown in U.S. Pat. No. 4,730,524 to Petersen that also includes a summary of the many Petersen Vise-Grip patents.

In addition to the micro adjustment screw for setting up the jaw spacing, some locking pliers include macro jaw opening mechanisms to allow use on a much wider range of work pieces. For example, U.S. Pat. No. 2,399,454 to Snell locates the jaw pivot in a slot in the upper jaw handle that is perpendicular to the upper jaw. The jaw pivot is adjusted along the slot by a screw with a head above the upper jaw handle. Turning the screw one way places the jaws closer together. Turning the screw the other way places the jaws further apart. Because of the fine spacing between the jaws that is possible using the screw, no separate micro adjustment screw in the handle is needed to set up the over-center locking mechanism as is found in the Peterson Vise-Grips.

U.S. Pat. Nos. 2,905,038 and 3,241,410 both to Paden have a long shank on the lower jaw holder. The lower jaw can be slid along the shank to determine the spacing between the jaws. The side of the shank has a series of teeth for holding the jaw. A pawl on the lower jaw engages any one of the teeth on the shank to hold the lower jaw in a given position relative to the upper jaw. Twenty-three positions are available on the embodiment shown in U.S. Pat. No. 2,905,038. Twenty positions are available on the embodiment shown in U.S. Pat. No. 3,241,410.

U.S. Pat. No. 3,672,245 to Hoffman is similar to Snell in that it has a slot perpendicular to the upper jaw in the upper jaw handle for holding the jaw pivot. But instead of using a screw to determine the location of the pivot in the slot, the position is determine by arcuate channels adjacent the slot for holding the lower jaw pivot ata desired spacing from the fixed upper jaw. Movement between the arcuate channels is achieved by loosening a nut on the pivot until the movable jaw can be slipped over the arcuate channels to a different set of arcuate channels. The nut is then tightened on the pivot to hold the pivot at a selected set of arcuate channels. Seven positions are available on the embodiment shown.

U.S. Pat. No. 3,981,209 to Caroff shows a locking pliers where the length of the link between the two handles is adjustable to control both the micro and macro jaw adjustment functions. Again a slot perpendicular to the upper jaw as in Hoffman and Snell is provided in the upper jaw handle. The length of the link is first adjusted to allow the pivot for the movable jaw to be moved in the slot toward or away from the fixed jaw. When the desired position is reached, the pivot is pushed into one of a plurality of teeth on the side of the slot opposite the link. The jaws are then moved around the work piece and the length of the link is further adjusted until the micro jaw adjustment is achieved that causes the jaws to lock on the work piece using the over-center principle when the handles are squeezed together. Five positions are available on the embodiment shown.

U.S. Pat. Nos. 6,578,452 and 5,022,290 both to Duffy have an upper jaw on a slide that moves in a slot in the lower jaw holder. The edge of the slide has a plurality of teeth for holding the jaw. A lock engages any one of the teeth to hold the upper jaw in a desired position with respect to the lower jaw. Three positions are available on the embodiment shown in U.S. Pat. No. 5,022,290. Thirty positions are available on the embodiment shown in U.S. Pat. No. 6,578,452.

U.S. Pat. No. 5,385,072 to Neff also has a slot in the holder for the lower jaw but moves the lower jaw in the slot instead of the upper jaw as in Duffy. Pins through the slot hold the lower jaw. The position of the lower jaw relative to the upper jaw is determined by an adjusting lever. About twelve positions are available on the embodiment shown. Jaw adjustment mechanisms are also known in non-locking pliers. For example, U.S. Pat. No. 4,581,960 to Putsch shows a pliers having two handles that cross each other and are connected together by a pivot. The pivot is attached to one of the handles and slides in a slot in the other handle to change the gap between the jaws. The sides of the slot have teeth. The pivot is mounted in a rectangular block having teeth on the sides matching the teeth on the sides of the slot. A push button on the end of the pivot is pushed to move the rectangular block out of the slot. This allows the pivot to be moved along the slot to a new position. When the push button is released, a spring on the other end of the pivot forces the rectangular block back into the slot where the teeth once again engage each other locking the pivot at a desired location. About twelve positions are available on the embodiment shown.

BRIEF SUMMARY OF THE INVENTION

The present invention is directed to a push-button locking pliers having a plurality of macro jaw width stations for grasping a wide variety of objects. A positioning mechanism is connected to a movable jaw member and cooperates with a jaw adjustment slot in the main handle. The positioning mechanism is released by pushing on a push button allowing it to move along the slot. The user places the positioning mechanism at the jaw positioning station that creates a macro spacing between the fixed and movable jaws that best fits the object to be grasped. An adjustment screw adjusts the micro spacing between the jaws to allow the pliers to lock on the object using an over-center mechanism when the handles are squeezed.

In accordance with a preferred embodiment, the main handle has a fixed jaw, an adjustment slot with a plurality of jaw positioning stations, and a distal end spaced from the fixed jaw with an adjustment screw. A locking handle having a jaw end and a distal end is under the main handle. A movable jaw member is pivotally coupled to the jaw end of the locking handle and has a movable jaw and the positioning mechanism. The positioning mechanism includes a pivot with an engaged position and a disengaged position, a pivot spring for biasing the pivot in the engaged position, and a push button for pushing the pivot out of the engaged position against the bias of the pivot spring. The pivot is positioned in the adjustment slot and pivotally connects the main handle to the movable jaw member. The pivot is movable by pressing the push button to disengage the pivot. After it is moved to one of the other jaw positioning stations, it is engaged in the new stations by releasing the push button. A link member is pivotally connected to the locking handle and engages the adjustment screw to provide the micro adjustment of the pliers. An over-center spring is connected between the main handle and the movable jaw member and holds the end of the link against the adjustment screw. The main handle with the fixed jaw and adjustment screw, the locking handle with the link member, the movable jaw member with the movable jaw, and the over-center spring comprise an over-center mechanism for locking the fixed and movable jaws on an object.

In a feature of the embodiment, three jaw positioning stations are provided along the slot. The user initially selects one of the three stations to best position the pliers on an object.

In accordance with a preferred embodiment, each jaw positioning station includes a rounded hole. The pivot has a longitudinal axis with a rounded shoulder substantially matching the rounded hole, a reduced portion less than the size of the rounded hole, and a push button on the end that is biased away from the rounded hole by the pivot spring. The pivot spring biases the pivot along the longitudinal axis. The rounded shoulder is positioned in the rounded hole by the pivot spring when the push button is not pushed thereby causing the movable jaw member to pivot on the main handle at the jaw positioning station. When the pivot is pushed along its longitudinal axis by the push button, the reduced portion is positioned in the rounded hole allowing the pivot to be moved between positioning stations. In accordance with an alternative embodiment of the invention, the pivot is modified to have two rounded shoulders substantially matching the rounded hole, two substantially parallel flats along the longitudinal axis between the two rounded shoulders, and the pivot spring biases the pivot rotationally about the longitudinal axis. When the push button is not pushed, the two rounded shoulders are positioned in the rounded hole by the pivot spring thereby pivoting the movable jaw member on the main handle at the jaw positioning station. When the push button is pushed, the two parallel flats are positioned in the rounded hole thereby allowing the pivot to be moved between positioning stations.

In other alternative embodiments, a plurality of teeth are provided along the sides of the slot or the face of the handle to provide the macro jaw spacing adjustment. In accordance with another aspect of the invention, the plurality of jaw positioning stations includes a most closed jaw positioning station and an opposite most open jaw positioning station. The jaws may be moved to the most closed position by pushing the push button to release the pivot and allowing the over-center spring to pull the positioning mechanism to the most closed jaw positioning station.

In accordance with a feature of the invention, the process of moving the positioning mechanism to the most closed jaw positioning station may be enhanced by manually pressing the fixed jaw and movable jaw together after the push button has been pressed.

In accordance with another aspect of the invention, the jaws may be moved to the most open position by pushing the push button to release the pivot and pressing the distal ends of the main and locking handles together pivoting the fixed and movable jaws apart around where the link member engages the adjustment screw.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
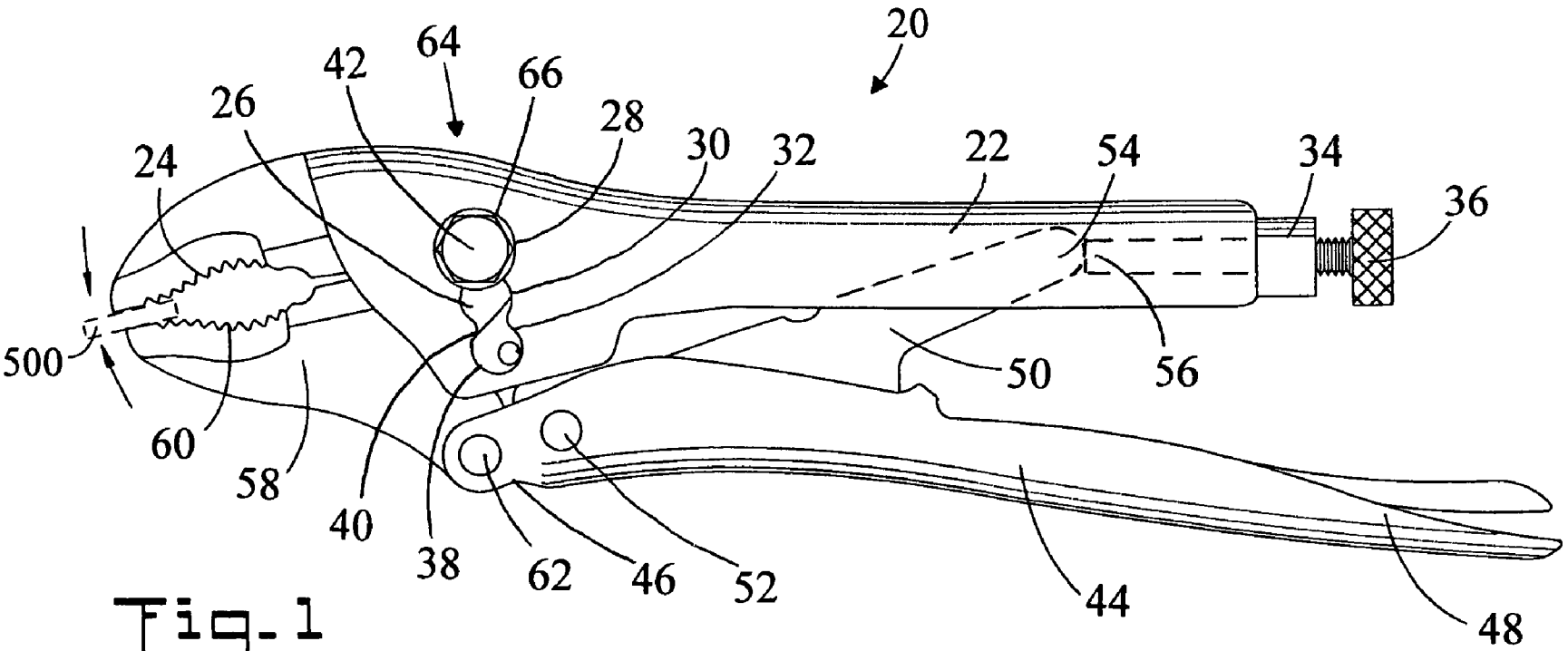
FIG. 1 is a side elevation view of a push button multi-position locking pliers in accordance with the present invention showing the jaws in a most closed position.
Figure 13:
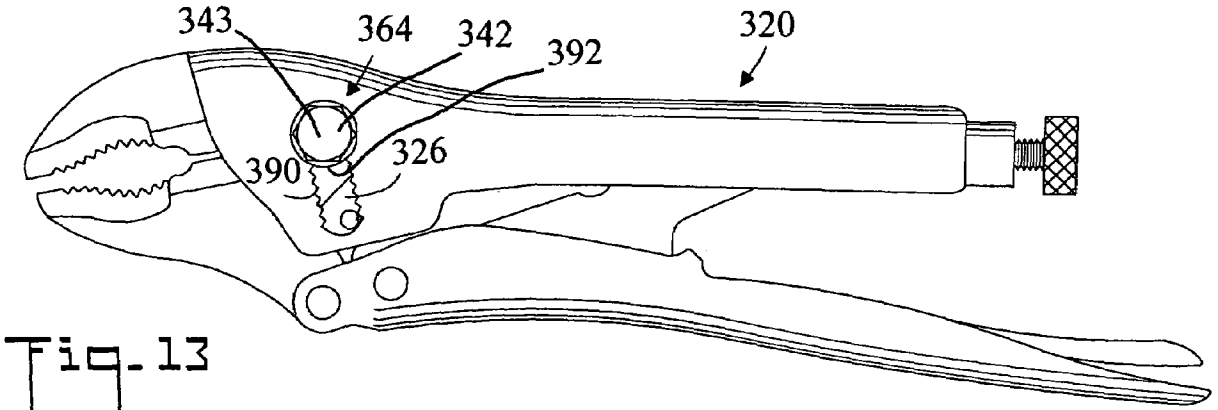
FIG. 13 is a side elevation view of the locking pliers showing a third embodiment of an adjustment slot and positioning mechanism having teeth in the slot; and, FIG. 14 is a side elevation view of the locking pliers showing a fourth embodiment of the adjustment slot and positioning mechanism having teeth on the face of the main handle.
Figure 14:
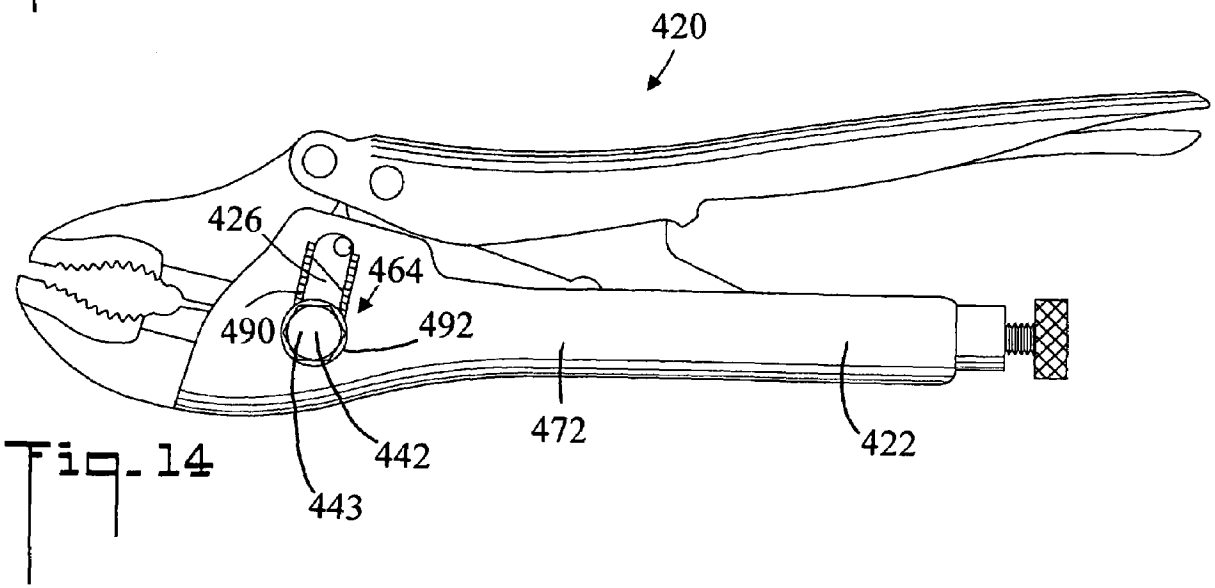

FIG. 1 illustrates a side elevation view of a push button multi-position locking pliers for grasping an object in accordance with the present invention showing the jaws in a most closed position, the locking pliers generally designated as 20. Locking pliers 20 includes a main handle 22 having a fixed jaw 24, an adjustment slot 26 having a plurality of jaw positioning stations 28, 30, 32, and a distal end 34 spaced from the fixed jaw having an adjustment screw 36. The plurality of jaw positioning stations 28, 30, 32 includes a most closed jaw positioning station 28 shown being used in FIG. 1 and an opposite most open jaw positioning station 32 shown being used in FIG. 3. In the embodiment of the invention shown in the drawings, three jaw positioning stations 28, 30, 32 are provided, each jaw positioning station having a rounded hole 38 with a reduced portion 40 between the holes to create the slot. Other possible configurations for jaw positioning stations are shown in FIGS. 13 and 14. Three jaw positioning stations have been found to be useful because they provide a wide range of macro jaw openings in the pliers which is limited only by the width of the pliers from the top to the bottom while retaining enough of the rounded holes of the positioning stations to support the forces on the pivot 42 between the jaws.

A locking handle 44 is located below the main handle and has a jaw end 46, a distal end 48 spaced from the jaw end, and a link member 50 pivotally connected to the locking handle by a link pivot 52. The opposite end 54 of the link member 50 abuts the end 56 of the adjustment screw 36 in the main handle 22 shown by the broken lines to provide micro jaw opening adjustments in a manner well known in the over-center locking pliers art. A movable jaw member 58 having a movable jaw 60 is pivotally connected to the jaw end 46 of the locking handle 44 by a locking handle pivot 62 and has a positioning mechanism 64. The positioning mechanism 64 engages adjustment slot 26 and is selectively movable to all of the jaw positioning stations 28, 30, 32. In FIG. 1, positioning mechanism 64 has been moved to the jaw positioning station 28 that causes fixe'd jaw 24 and movable jaw 60 to be in a most closed position.

Figure 6:
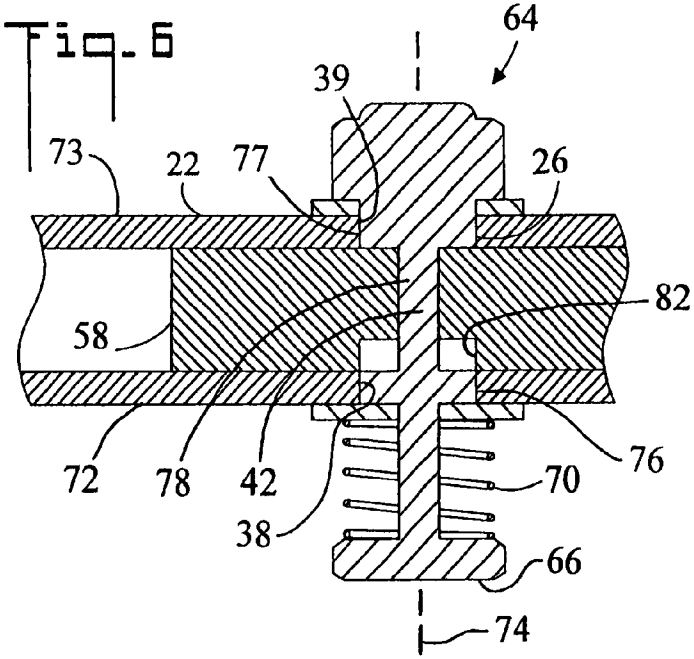
FIG. 6 is an enlarged cross sectional view along the line 6-6 of FIG. 5.
Figure 7:
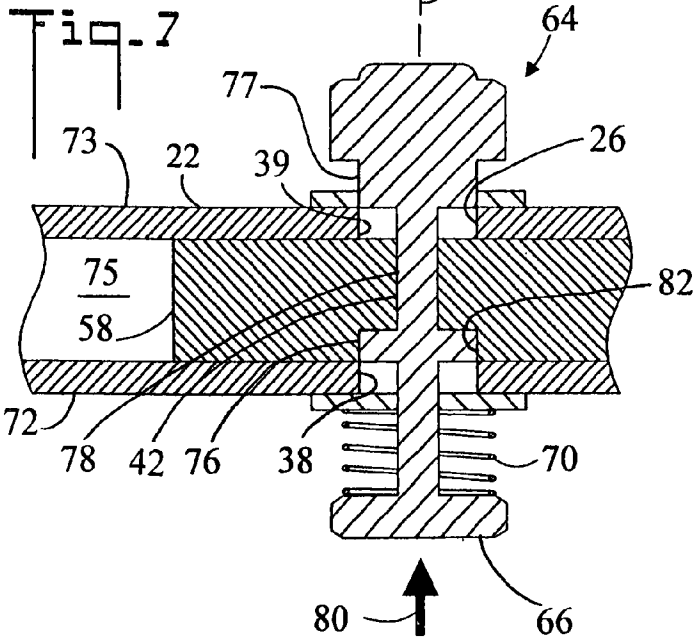
FIG. 7 is an enlarged cross sectional view similar to FIG. 6 with the push button pushed disengaging the pivot.

The positioning mechanism 64 includes the pivot 42. The pivot has a locked position as shown in FIG. 6 and a disengaged position as shown in FIG. 7. A pivot spring biases the pivot in the locked position. A push button 66 is used to push the pivot 42 out of the locked position against the pivot spring bias so the pivot can be moved to another positioning station such as stations 30 or 32. The pivot 42 positioned in the adjustment slot 26 pivotally connects the main handle 22 to the movable jaw member 58. After the pivot is moved to a new jaw positioning station, the push button is released and the pivot spring pushes the pivot back into a locked position in the new jaw positioning station.

Figure 3:
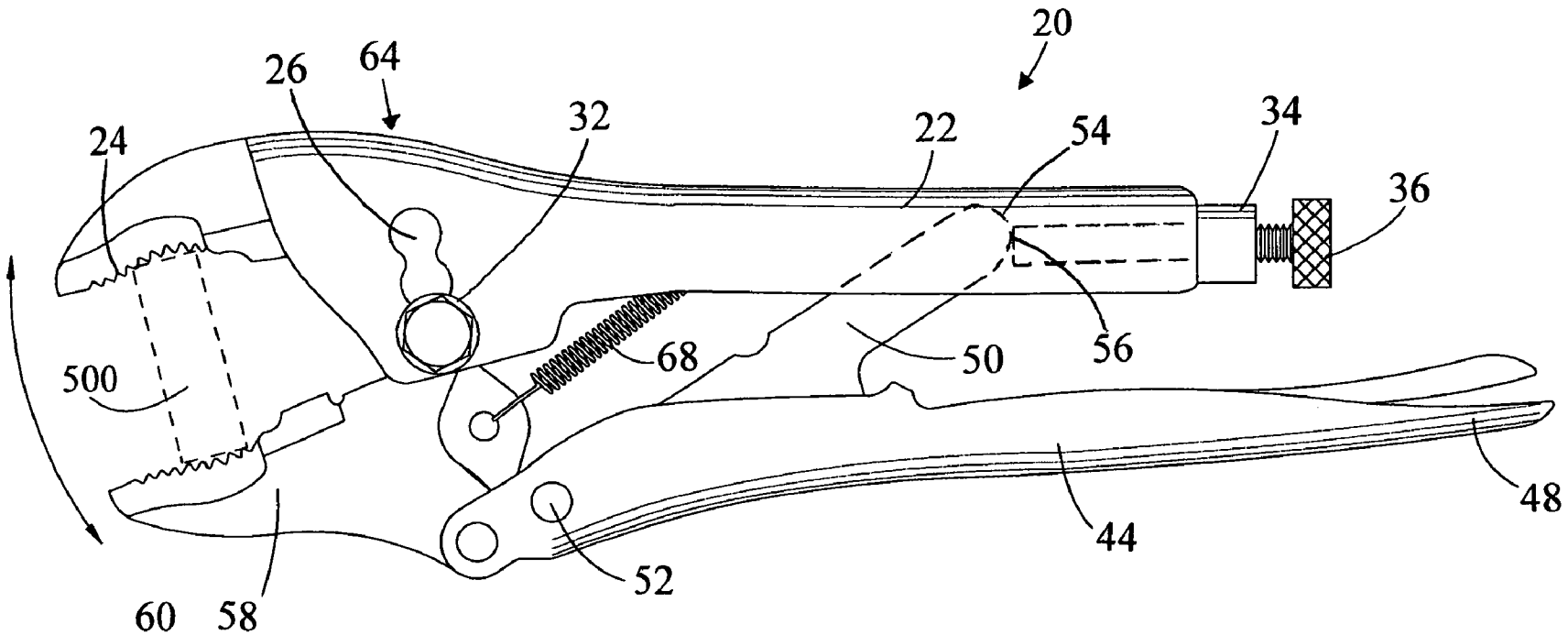
FIG. 3 is a side elevation view of the locking pliers in a most open position.
Figure 4:
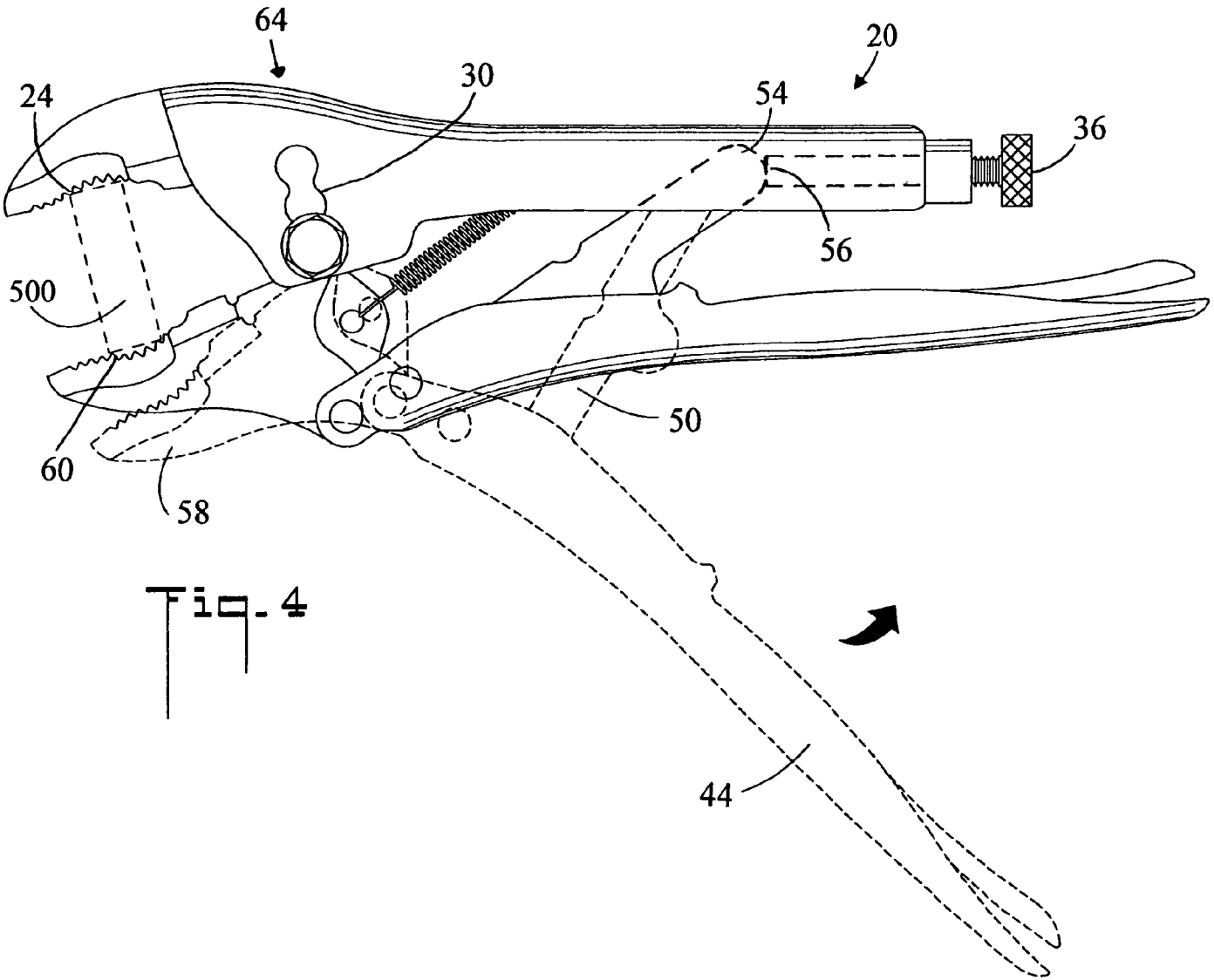
FIG. 4 is side elevation view of the locking pliers of FIG. 3 showing the conventional clamping action of the over-center mechanism.
Figure 8:
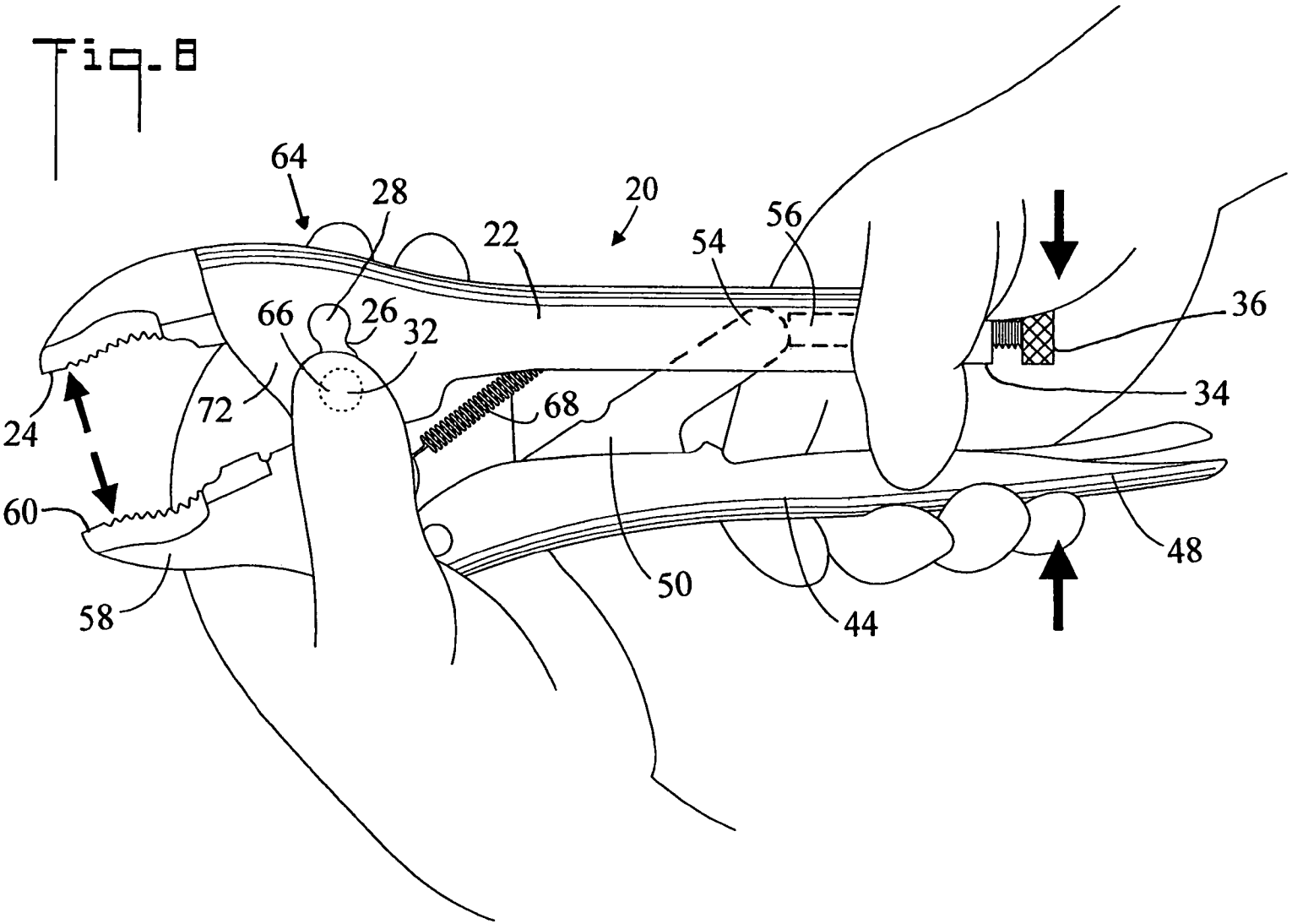
FIG. 8 is a side elevation view showing how the jaws of the locking pliers are moved from a most closed position to a most open position.

An over-center spring 68 shown in FIGS. 3, 4, and 8 is connected between the main handle 22 and the movable jaw member 58 to keep the end 54 of link member 50 pressed against the end 56 of adjustment screw 36 in a manner well know in the prior art. Main handle 22, adjustment screw 36, locking handle 44, movable jaw member 58, and over-center spring 68 comprise a conventional over-center mechanism that clamps fixed jaw 24 and movable jaw 60 on an object 500.

Figure 2:
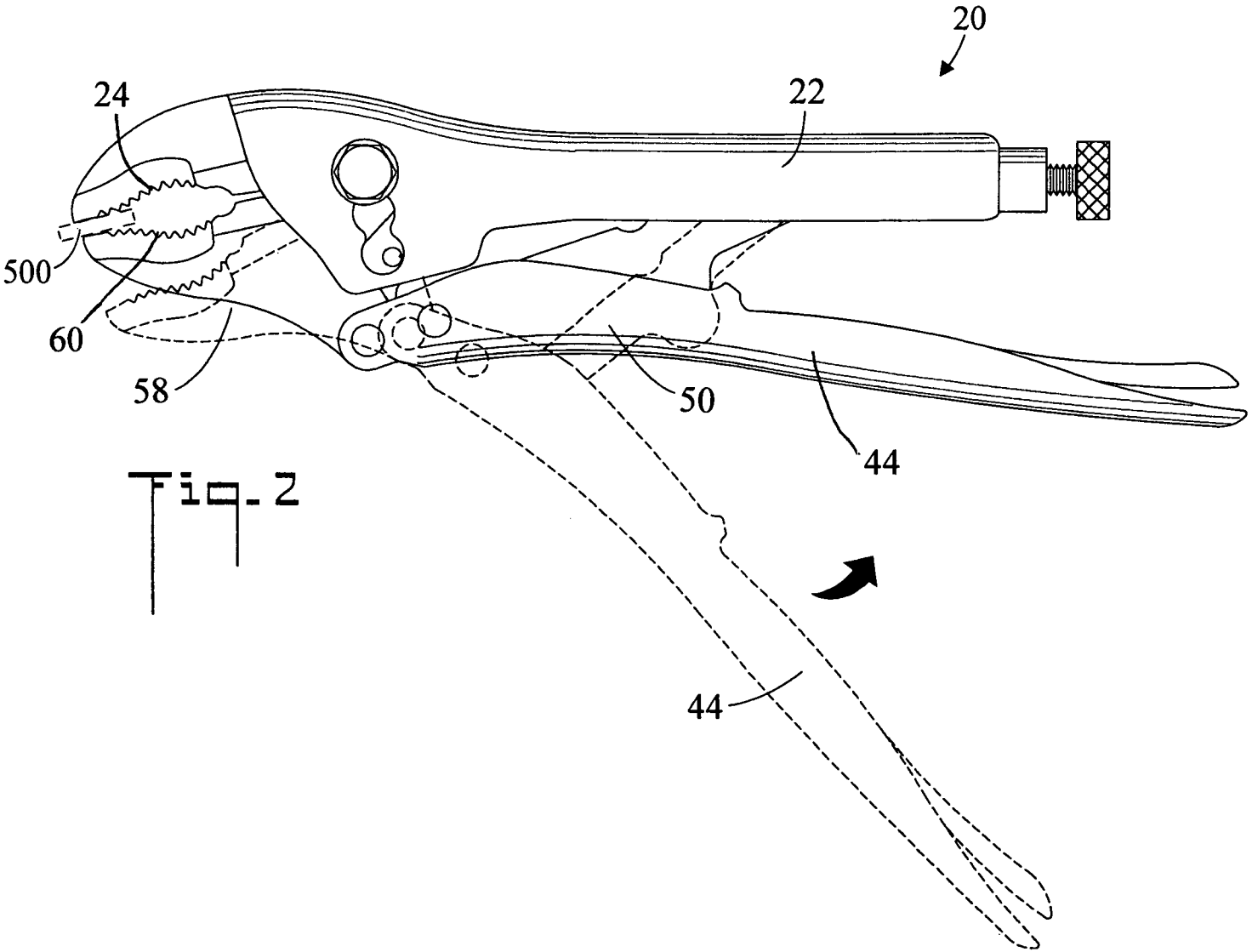
FIG. 2 is a side elevation view of the locking pliers of FIG. 1 showing the conventional clamping action of the over-center mechanism.

FIG. 2 is a side elevation view of locking pliers 20 showing the conventional clamping action of the over-center mechanism with fixed jaw 24 and movable jaw 60 on an object 500. The positions of locking handle 44, link member 50, and movable jaw member 58 prior to clamping are shown in broken lines.

FIG. 3 is a side elevation view of locking pliers 20 in the most open position. Positioning mechanism 64 has been moved to, the jaw positioning station 32 at the bottom of the slot 26 that causes fixed jaw 24 and movable jaw 60 to be the furthest apart. In this position, the jaws can clamp on a larger object 500 than is possible in the position shown in FIGS. 1 and 2. Over-center spring 68 is connected between main handle 22 and movable jaw member 58 keeping the end 54 of link member 50 pressed against the end 56 of adjustment screw 36.

FIG. 4 is side elevation view of the locking pliers of FIG. 3 showing the conventional clamping action of the over-center mechanism that clamps fixed jaw 24 and movable jaw 60 on the larger object 500. The positions of locking handle 44, link member 50, and movable jaw member 58 prior to clamping are shown in broken lines. If an intermediate macro jaw width adjustment is desired, the positioning mechanism 64 is moved to the jaw positioning station 30 in the middle between the positions shown in FIGS. 1 and 3. The micro jaw width adjustment required by all over-center locking pliers to lock on any give object is provided in all three positioning stations by the end 56 of adjustment screw 36 abutting the end 54 of link member 50 in a manner well know in the art.

Figure 5:
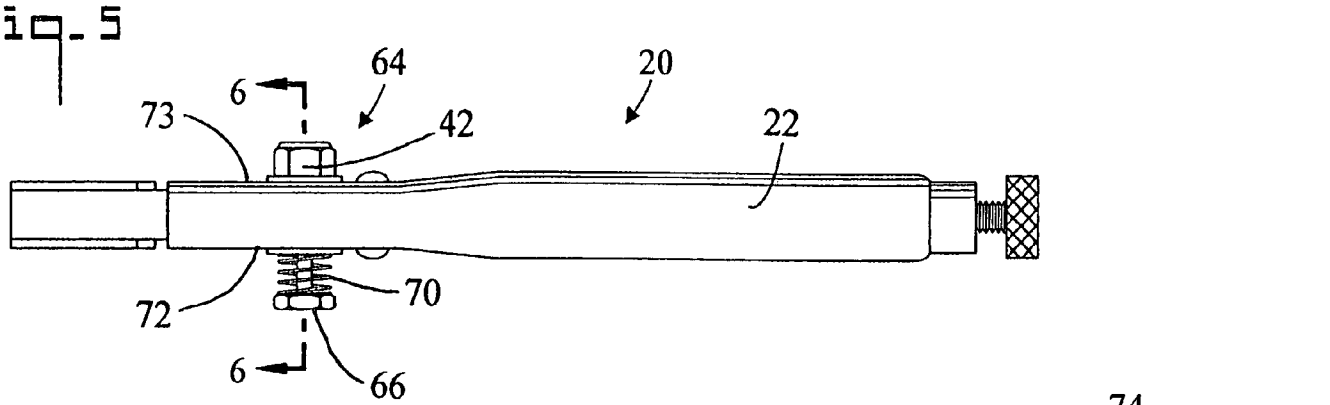
FIG. 5 is a top plan view of the locking pliers.

FIG. 5 is a top plan view of locking pliers 20 showing pivot coil spring 70 of positioning mechanism 64 biasing pivot 42 in a jaw positioning station such as positioning station 32 of FIGS. 1 and 2 by pushing the push button 66 on the end of pivot 42 away from the first side 72 of main handle 22. The positioning mechanism is disengaged by pushing push button 66 toward the first side 72 of main handle 22 against the bias of pivot spring 70.

FIG. 6 is an enlarged cross sectional view along the line 6-6 of FIG. 5. Positioning mechanism 64 includes pivot 42 that is selectively movable between a locked position shown in FIG. 6 and a disengaged position shown in FIG. 7. Pivot 42 has a longitudinal axis 74, rounded shoulders 76 that match the rounded holes 38 of adjustment slot 26, a reduced portion 78 less than the size of the rounded holes 38, and the push button 66. The pivot spring 70 biases the pivot along the longitudinal axis 74 away from the side 72 of main handle 22 so that rounded shoulders 76 engage the rounded hole 38 of jaw positioning station 32 thereby locking pivot 42 in place (refer to FIGS. 1 and 2). Movable jaw member 58 then pivots about main handle 22 at that location.

FIG. 7 is an enlarged cross sectional view similar to FIG. 6 showing positioning mechanism 64 moved to the disengaged position. The movable jaw member 58 is positioned in the space 75 between the first and second sides 72, 73 of main handle 22. The disengaged position is achieved by pressing push button 66 on the end of pivot 42 along its longitudinal axis 74 in the direction indicated by arrow 80 toward main handle 22 against the bias of pivot spring 70. This causes first rounded shoulder 76 to move out of first rounded hole 38 of first side 72 and second rounded shoulder 77 to move out of second rounded hole 39 of second side 73 in the main handle 22 on both sides of the movable jaw member 58. The upper second rounded shoulder 77 as shown in the drawing moves above the upper second side 73 of the main handle while the lower first rounded shoulder 76 moves into a relief 82 in movable jaw member 58 thereby permitting the reduced portion 78 of pivot 42 to be moved along jaw adjustment slot 26 to another jaw positioning station.

FIG. 8 is a side elevation view showing how jaws 24 and 60 of locking pliers 20 are moved from a most closed position to a most open position at jaw positioning station 32. Starting from the most closed position of FIG. 1, a user simultaneously disengages positioning mechanism 64 by pressing push button 66 toward the first side 72 of main handle 22 (refer to FIG. 7) and manually urges the distal ends 24 and 48 of the main handle 22 and locking handle 44 together. This causes locking handle 44 to pivot on main handle 22 about where end 54 of link member 50 and end 56 of adjustment screw 36 abut. In so doing, this forces jaws 24 and 60 apart to the most open position shown against the pull of over-center spring 68. As shown in FIG. 8, locking handle 44 is at least as long as main handle 22 to allow both to be gripped simultaneously by one hand of a user so that distal ends 24 and 48 can be urged together as shown by the arrows. Also as shown in the drawing, the length of the outer portion of the locking handle 44 from the handle pivot point to distal end 48 and the length of the inner portion from the handle pivot point to the jaw end 46 (FIG. 1) are substantially the same. When the most open position is reached, push button 66 is released allowing pivot spring 70 under push button 66 to lock the pivot in the new positioning station as shown in FIG. 6.

Conversely, the most closed position of FIG. 1 may be achieved from a more open position such as shown in FIG. 8 by pressing push button 66 of pivot 42 to disengage pivot 42 as shown in FIG. 7. Over-center spring 68 then pulls movable jaw members 58 toward main handle 22 thereby placing jaws 24 and 60 in their most closed position. The narrowing can be facilitated by manually pressing the fixed jaw 24 and movable jaw 60 together.

Figure 9:
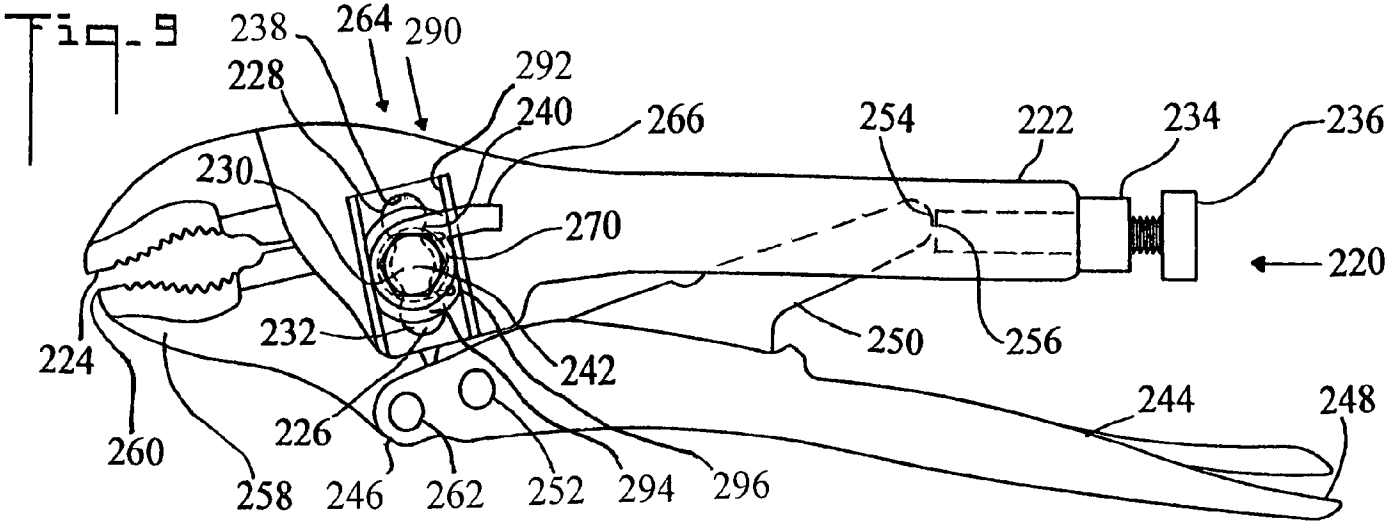
FIG. 9 is a side elevation view of the locking pliers showing a second embodiment of the adjustment slot and positioning mechanism having a rotary pivot release.

FIG. 9 is a side elevation view of the locking pliers showing a second embodiment of the adjustment slot and positioning mechanism having a rotary pivot release instead of a longitudinal pivot release, the locking pliers generally designated as 220. Locking pliers 220 includes a main handle 222 having a fixed jaw 224, an adjustment slot 226 having a plurality of jaw positioning stations 228, 230, 232, and a distal end 234 spaced from the fixed jaw having an adjustment screw 236. In the embodiment of the invention shown in the drawings, three jaw positioning stations are provided, each jaw positioning station having a rounded hole 238 with a reduced portion 240 between the holes to create the slot.

A locking handle 244 is located below the main handle and has a jaw end 246, a distal end 248 spaced from the jaw end, and a link member 250 pivotally connected to the locking handle by a link pivot 252. The opposite end 254 of the link member engages end 256 of adjustment screw 236 in the main handle to provide micro jaw opening adjustments in a manner well known in the over-center locking pliers art. A movable jaw member 258 having a movable jaw 260 is pivotally connected to the jaw end 246 of the locking handle 244 by a locking handle pivot 262 and has a positioning mechanism 264. The positioning mechanism 264 engages adjustment slot 226 and is selectively movable to all of the jaw positioning stations 228, 230, 232. In FIG. 9, positioning mechanism 264 has been moved to the middle jaw positioning station 230.

The positioning mechanism 264 includes a pivot 242 having an engaged positions as shown in FIG. 9 and a disengaged position when rotated 90 degrees. A pivot spring 270 biases the pivot in the engaged position. A push button 266 is used to rotate the pivot 90 degrees out of the engaged position against the pivot spring bias so the pivot can be moved to another positioning station. The pivot 242 positioned in the adjustment slot 226 pivotally connects the main handle 222 to the movable jaw member 258. After the pivot is moved to a new jaw positioning station, the push button 266 is released allowing the pivot spring 270 to push the pivot back into an engaged position in the new jaw positioning station. A guide means 290 comprised of a wall 292 on main handle 222 parallel to slot 226 and between slot 226 and the over-center spring and a washer 294 on pivot 242 having a flat side 296 that abuts wall 292 keeps pivot 242 in the middle of the slot when it is moved between jaw positioning stations 228, 230, 232. As noted above in the description of FIG. 8, the over-center spring, which is not shown in FIG. 9 but is identical to over-center spring 68 in FIGS. 3, 4, and 8, pulls movable jaw member 258 and with it pivot 242 toward main handle 222. Without guide means 290, the over-center spring would pull pivot 242 against the right side of slot 226 as shown in FIG. 9 making it difficult to align pivot 242 with a new positioning station because it would not be in the center of the slot when it reached the new positioning station. Guide means 290 facilitates the positioning of pivot 242 at a new positioning station because it always keeps pivot 242 in the middle of the slot. The remaining features of the second embodiment 220 shown in FIG. 9 are identical to those shown in FIGS. 1-4.

Figure 10:
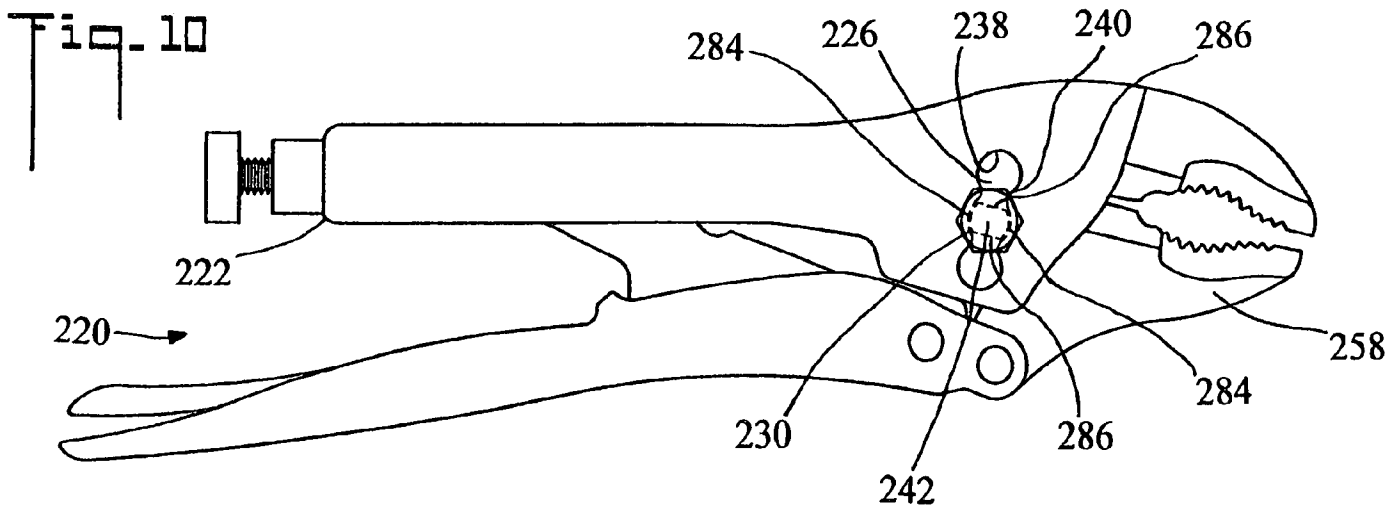
FIG. 10 is an opposite side elevation view of the embodiment of FIG. 9.

FIG. 10 is an opposite side elevation view of the second embodiment of FIG. 9 showing the features of the pivot 242 in relation to the rounded hole 238 of the middle positioning station 230 of jaw adjustment slot 226 in broken lines. Pivot 242 has two rounded shoulders 284 substantially matching the round hole 238 of positioning station 230 that provide the surfaces on which movable jaw member 258 pivots in relation to main handle 222. Pivot 242 also has two substantially parallel flats 286 along its longitudinal axis between the two rounded shoulders 284. When the push button 266 of FIG. 9 is pushed 90 degrees to rotate the pivot 90 degrees, the rounded shoulders move out of the rounded hole of positioning station 230 into the reduced portion 240 of adjustment slot 226 between the positioning stations. Pivot 242 may then be moved along adjustment slot 226 to a new positioning station by passing the flats 286 between the positioning stations. When the new positioning station is reached, the push button 266 is released allowing the pivot spring 270 to rotate the pivot back to an engaged position where the two rounded shoulders 284 of the pivot match the rounded hole 238 of the new positioning station.

Figures 11, 12:
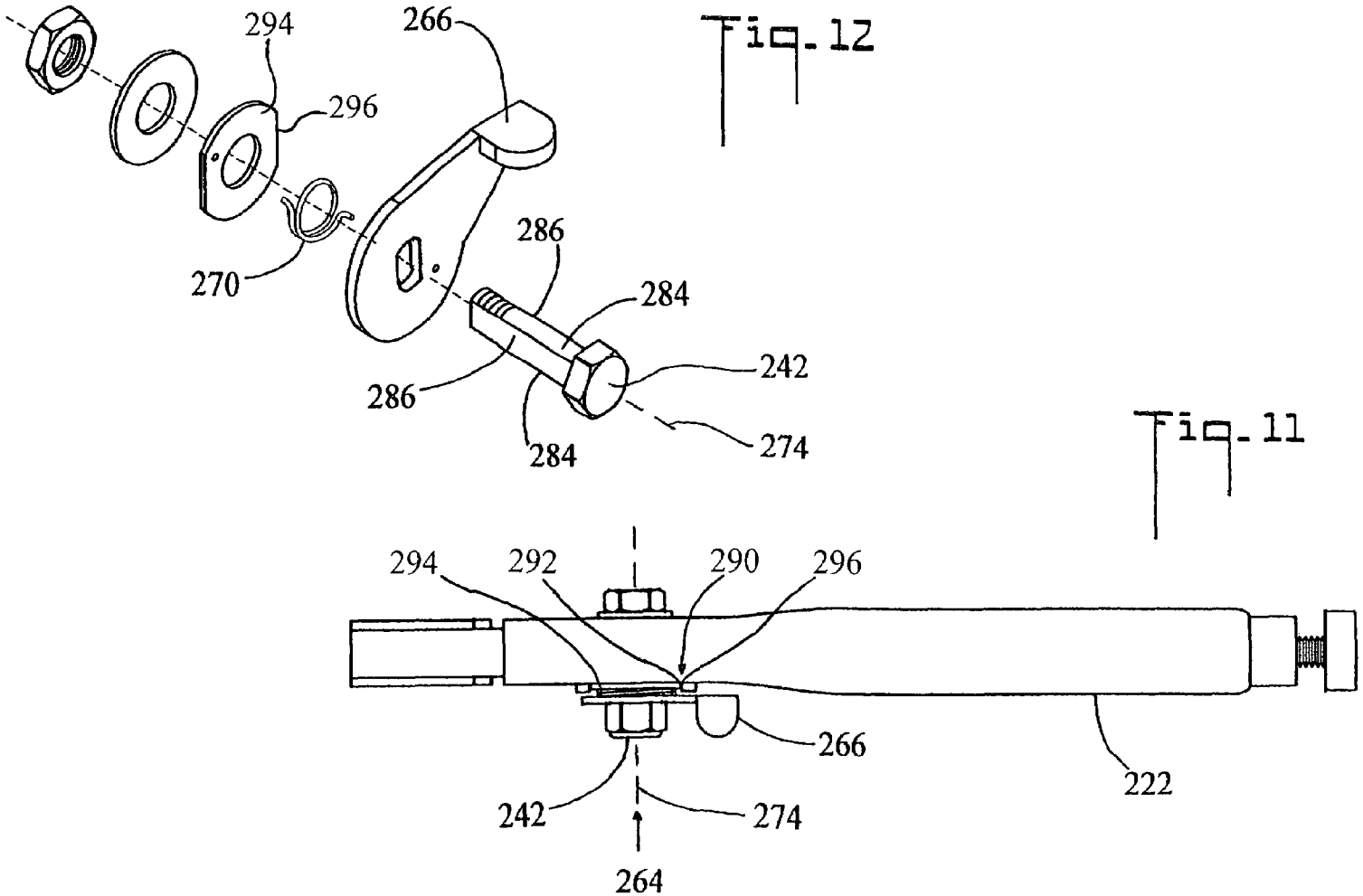
FIG. 11 is a top plan view of the embodiment of FIG. 9.
FIG. 12 is an exploded view of the positioning mechanism of the embodiment of FIG. 9.

FIG. 11 is a top plan view of the second embodiment of FIG. 9. The push button 266 is pushed down 90 degrees to rotate the pivot 242 about longitudinal axis 274 so positioning mechanism 264 may be moved in relation to main handle 222. Guide means 290 comprised of wall 292 parallel to the slot and between the slot and the over-center spring and a washer 294 on pivot 242 having a flat side 296 that abuts wall 292 keeps pivot 242 in the middle of the slot when it is moved between the jaw positioning stations.

FIG. 12 is an exploded view of the positioning mechanism of FIG. 9. Pivot 242 has two rounded shoulders 284 and two substantially parallel flats 286 along its longitudinal axis 274. When the push button 266 is pushed against the bias of pivot spring 270, pivot 242 is rotated putting the parallel flats in a position to pass between the positioning stations shown in FIGS. 9 and 10. The guide means for keeping the pivot 242 in the middle of the slot when it is moved between the jaw positioning stations includes washer 294 on pivot 242 having flat side 296 that abuts the wall to keep pivot 242 in the middle of the slot when it is moved between the jaw positioning stations.

FIG. 13 is a side elevation view of a third embodiment of the locking pliers with a different adjustment slot and positioning mechanism, generally designated 320. Both sides of adjustment slot 326 have a plurality of slot teeth 390 and the distal end 343 of pivot 342 has a plurality of pivot teeth 392 that engage the slot teeth to hold the positioning mechanism 364 and any selected jaw positioning station. All other aspects of this embodiment are the same as for the first embodiment of FIGS. 1-8 which are incorporated herein by reference. The positioning mechanism 364 is disengaged by pressing on the push button on the other side of pliers 320 to lift the pivot teeth out of the slot teeth freeing the positioning mechanism to move to a new jaw positioning station along adjustment slot 326.

FIG. 14 is a side elevation view of a fourth embodiment of the locking pliers with a different adjustment slot and positioning mechanism, generally designated 420. The side 472 of main handle 422 adjacent adjustment slot 426 has a plurality of face teeth 490 and the distal end 443 of pivot 442 has a plurality of pivot teeth 492 that engage the face teeth to hold the positioning mechanism 464 at any selected jaw positioning station. The face teeth 490 of this embodiment are perpendicular to the slot teeth 390 of the third embodiment. All other aspects of this embodiment are the same as for the first embodiment of FIGS. 1-8 which are incorporated herein by reference. The positioning mechanism 464 is disengaged by pressing on the push button on the other side of pliers 420 to lift the pivot teeth off of the face teeth freeing the positioning mechanism to move to a new jaw positioning station along adjustment slot 426.

In terms of use, a method for placing the jaws of the locking pliers shown in a most closed position includes:

(a) providing locking pliers 20, including;

a main handle 22 having a fixed jaw 24, an adjustment slot 26 having a plurality of jaw positioning stations 28, 30, 32, and a distal end 34 spaced from the fixed jaw having an adjustment screw 36;

a locking handle 44 having a jaw end 46 and a distal end 48 spaced from the jaw end;

a movable jaw member 58 pivotally coupled to the jaw end 46 of the locking handle 44 and having a movable jaw 60 and a positioning mechanism 64;

the positioning mechanism having a pivot 42 with a disengaged position and a disengaged position, a pivot spring 70 for biasing the pivot in the engaged position, and a push button 66 for pushing the pivot out of the engaged position against the pivot spring bias;

the pivot positioned in the adjustment slot to pivotally connect the main handle to the movable jaw member and movable by pressing the push button to unlock the pivot and move the pivot to one of the plurality of jaw positioning stations and lock in the one of the plurality of jaw positioning stations upon release of the push button;

a link member 50 pivotally connected to the locking handle and engaging the adjustment screw;

an over-center spring 68 connected between the main handle and the movable jaw member;

the main handle with the fixed jaw and the adjustment screw, the locking handle, the movable jaw member with the link member, and the over-center spring comprising an over-center mechanism for locking the fixed and movable jaws on the object; and, the plurality of jaw positioning stations including a most closed jaw positioning station 28, and an opposite most open jaw positioning station 32;

(b) with positioning mechanism 64 not in most closed jaw positioning station 28, pressing push button 66 thereby disengaging positioning mechanism 64 and positioning mechanism 64 to be urged to the most closed jaw positioning station by over-center spring 68; and, (c) allowing over-center spring 68 to pull positioning mechanism 64 to the most closed jaw positioning station 28.

The method further including:

simultaneously with step (b), manually pressing fixed jaw 24 and movable jaw 60 together.

Conversely, a method for placing the jaws of locking pliers in a most open position includes:

(a) providing locking pliers 20, including;

a main handle 22 having a fixed jaw 24, an adjustment slot 26 having a plurality of jaw positioning stations 28, 30, 32, and a distal end 34 spaced from the fixed jaw having an adjustment screw 36;

a locking handle 44 having a jaw end 46 and a distal end 48 spaced from the jaw end;

a movable jaw member 58 pivotally coupled to the jaw end 46 of the locking handle 44 and having a movable jaw 60 and a positioning mechanism 64;

the positioning mechanism having a pivot 42 with an engaged position and an disengaged position, a pivot spring 70 for biasing the pivot in the engaged position, and a push button 66 for pushing the pivot out of the engaged position against the pivot spring bias;

the pivot positioned in the adjustment slot to pivotally connect the main handle to the movable jaw member and movable by pressing the push button to unlock the pivot and move the pivot to one of the plurality of jaw positioning stations and lock in the one of the plurality of jaw positioning stations upon release of the push button;

a link member 50 pivotally connected to the locking handle and engaging the adjustment screw;

an over-center spring 68 connected between the main handle and the movable jaw member; the main handle with the fixed jaw and the adjustment screw, the locking handle, the movable jaw member with the link member, and the over-center spring comprising an over-center mechanism for locking the fixed and movable jaws on the object; and, the plurality of jaw positioning stations including a most closed jaw positioning station 28, and an opposite most open jaw positioning station 32;

(b) with positioning mechanism 64 not in the most open jaw positioning station, simultaneously pressing push button 66 thereby disengaging positioning mechanism 64, and manually urging distal ends 34 and 48 of main handle 22 and locking handle 44 together.

The preferred embodiments of the invention described herein are exemplary and numerous modifications, variations, and rearrangements can be readily envisioned to achieve an equivalent result, all of which are intended to be embraced within the scope of the appended claims.

I claim:

1. A push button multi-position locking pliers for grasping an object, comprising:

a main handle having a fixed jaw, an adjustment slot having a plurality of jaw positioning stations, and a distal end spaced from said fixed jaw having an adjustment screw;

a locking handle having a jaw end and a distal end spaced from said jaw end;

a movable jaw member pivotally coupled to said jaw end of said locking handle and having a movable jaw and a positioning mechanism;

said positioning mechanism having a pivot with an engaged position and a disengaged position, a pivot spring for biasing said pivot in said engaged position, and a push button for pushing said pivot out of said engaged position against said pivot spring bias;

said pivot positioned in said adjustment slot to pivotally connect said main handle to said movable jaw member and movable by pressing said push button to unlock said pivot and move said pivot to one of said plurality of jaw positioning stations and lock in said one of said plurality of jaw positioning stations upon release of said push button;

a link member pivotally connected to said locking handle and engaging said adjustment screw;

an over-center spring connected between said main handle and said movable jaw member;

said main handle with said fixed jaw and said adjustment screw, said locking handle with said link member, said movable jaw member with said movable jaw, and said over-center spring comprising an over-center mechanism for locking said fixed and movable jaws on the object;

each said jaw positioning station including a rounded hole;

said pivot having a longitudinal axis with two rounded shoulders substantially matching said rounded hole, two substantially parallel flats along said longitudinal axis between said two rounded shoulders, and a push button on the end of a lever mounted on an end of said pivot substantially perpendicular to said longitudinal axis;

said pivot spring biasing said pivot rotationally about said longitudinal axis;

said two rounded shoulders positioned in said rounded hole by said pivot spring when said push button is not pushed thereby pivoting said movable jaw member on said main handle at said jaw positioning station; and, said two parallel flats positioned in said rounded hole when said pivot is rotated about said longitudinal axis by pushing on said push button against said pivot spring bias thereby allowing said pivot to be moved between positioning stations;

a guide means having a wall on said main handle parallel to said slot and between said slot and said over-center spring and a washer on said pivot having a flat side that abuts said wall; and, said guide means keeping said pivot in the middle of said slot when said pivot is moved between said jaw positioning stations.

* * * * *